United States Patent [19]

Lott, Jr. et al.

[11] Patent Number: 4,575,983

[45] Date of Patent: Mar. 18, 1986

[54] SLIDING HOLD-DOWN CLIP FOR STANDING SEAM METAL ROOF

[75] Inventors: Hamilton Lott, Jr., Fort Wayne; Lynn E. Strock, Waterloo, both of Ind.

[73] Assignee: Nucor Corporation, Charlotte, N.C.

[21] Appl. No.: 697,148

[22] Filed: Feb. 1, 1985

[51] Int. Cl.[4] ..... E04D 1/34

[52] U.S. Cl. ..... 52/544; 52/520; 52/528; 52/547; 52/713

[58] Field of Search ..... 52/489, 492, 478, 520, 52/521, 522, 523, 524, 525, 526, 527, 528, 537, 538, 541, 543, 544, 545, 546, 547, 712, 713, 714, 715

[56] References Cited

U.S. PATENT DOCUMENTS

| | | | |
|---|---|---|---|
| 1,882,105 | 10/1932 | Wender | 52/544 X |
| 3,889,437 | 6/1975 | Day et al. | 52/520 |
| 3,998,019 | 12/1976 | Reinwall, Jr. | 52/545 X |
| 4,102,105 | 7/1978 | Taylor et al. | 52/528 X |
| 4,177,615 | 12/1979 | Anderson | 52/520 X |
| 4,193,247 | 3/1980 | Heckelsberg | 52/544 X |
| 4,213,282 | 7/1980 | Heckelsberg | 52/520 X |
| 4,361,998 | 12/1982 | Ellison et al. | 52/544 X |
| 4,435,937 | 3/1984 | Stone | 52/520 |
| 4,495,743 | 1/1985 | Ellison et al. | 52/545 X |
| 4,497,151 | 2/1985 | Simpson et al. | 52/543 X |
| 4,514,952 | 5/1985 | Johansson | 52/543 X |
| 4,522,005 | 6/1985 | Seaburg et al. | 52/547 X |

FOREIGN PATENT DOCUMENTS

| | | | |
|---|---|---|---|
| 706575 | 3/1965 | Canada | 52/544 |

*Primary Examiner*—Donald G. Kelly
*Assistant Examiner*—Richard E. Chilcot, Jr.
*Attorney, Agent, or Firm*—Shenier & O'Connor

[57] ABSTRACT

A sliding clip for a floating standing seam roof for allowing buckling of the roof panels to relieve excessive thermal expansion. The relative arrangement of the stops which limit the motion of the upper clip portion in respect of the lower clip portion is asymmetrical to allow a greater amplitude of motion of the upper clip portion toward the fixed ends of the roof panels caused by contraction than is permitted toward the floating ends of the roof panels caused by expansion. This prevents destruction of the clips or of the fasteners for the fixed ends. It also prevents rupture of the panels themselves at their fixed ends.

5 Claims, 4 Drawing Figures

SLIDING HOLD-DOWN CLIP FOR STANDING SEAM METAL ROOF

BACKGROUND OF THE INVENTION

Standing seam metal roofs are formed from a plurality of interconnected panels supported by purlins, or joists. The standing seams are constructed from interconnected roof panels. In the prior art, hold-down clips are interleaved between the abutting adjacent panels. The standing seams are difficult to seal against moisture. The sealing problem is exacerbated by the necessity that the roof panels be permitted to expand and contract in accordance with the temperature variations to which they are subjected. The stresses and strains introduced by the expansion and contraction of the roof panels has been alleviated, in the prior art, by providing clips with a sliding connection between the base secured to a purlin and the hold-down portion connected to a standing seam.

We have found that the problem is not completely solved by allowing thermal expansion and contraction of the panels, since clips of the prior art allow equal amounts of movement for expansion and contraction. The ambit of movement is limited by stops. These stops are carried by the base, which is attached to a purlin or the like. They are necessary to prevent the upper and lower parts from becoming free from each other. Since each standing seam panel is advantageously fixed only at its lowest point into a wall, sliding clips of the prior art allow the panel to move at all other points. Thus, when the temperature rises, the interconnected metal panels will expand and move uphill. The clip farthest from the fixed low end will move the farthest distance. If at a given temperature this distance is equal to the maximum possible movement permitted by the clip, a further increase in temperature will cause the panel to be subjected to compression. One of a number of things will then occur. A clip, or clips, may be destroyed; the fastening means at the low end of the panel may break; the low end of the panel itself may rupture; or the metal panel will buckle slightly. The slight buckling, necessary to relieve the compression, is transient and will not affect the performance of the roofing. The buckling of the panels acts as a safety valve and causes no permanent damage to the roofing system. If, on the other hand, the temperature drops, the panel will contract and move downhill. Again, at a given temperature, at some point, the maximum movement of the clip farthest from the low end of the panel is reached. If sufficient ambit of movement is not allowed, a further decrease in temperature will then cause the panel to be placed in tension. Since the panel is contracting, the result will be that one or more of the fasteners at the low end or the clip at the high end, or the panel itself at the low end, will fail.

We have found that a better standing seam roof can be constructed if the clip allows more contraction than expansion before encountering a stop, rather than allowing equal amounts of movement as is now done in the prior art. It should be noted that some manufacturers fix the panel at a place other than at the end. The result, however, is the same, no matter where the point of fixation is placed. There is always a fixed point and a floating point.

FIELD OF THE INVENTION

Our invention lies in the field of sliding hold-down clips in a standing seam metal roof which will prevent the roof from failing by allowing greater panel contraction than expansion owing to temperature variations.

DESCRIPTION OF THE PRIOR ART

U.S. Pat. No. 3,998,019 to Reinwall, Jr. shows a roof panel hold-down clip, adapted to slide as a unit, in which equal distances are provided for both contraction and expansion.

U.S. Pat. No. 4,034,532 to Reinwall, Jr. shows another form of sliding hold-down clip, in which equal distances are provided for both contraction and expansion. In this construction, the base is firmly secured to the infrastructure and the hold-down portion is allowed to slide in respect of the base.

U.S. Pat. No. 4,102,105 to Taylor et al shows a number of different constructions of hold-down clips which permit equal movements for both contraction and expansion.

U.S. Pat. Nos. 4,193,247 and 4,296,581 to Heckelsberg both show a compound hold-down clip in which the base is secured to a purlin and the clip is slidably mounted on the base. Again, equal ambits of travel are allowed between the clip and the base.

U.S. Pat. No. 4,361,998 to Ellison et al discloses a compound hold-down clip in which a base is secured to a purlin and the hold-down clip-portion is slidably mounted in a slot formed in the base. Equal limits of motion are provided for both contraction and expansion. The slot 29 in which the hold-down portion 38 moves is internally located, as can readily be seen in FIGS. 7 and 17 of this patent.

SUMMARY OF THE INVENTION

In general, our invention contemplates the provision of a sliding hold-down clip for standing seam roofs, in which there are stops for limiting the sliding movement, and in which a larger amplitude of motion is provided owing to contraction than is provided owing to expansion. By this construction, we are enabled to permit slight buckling of the roof panels and thus prevent any damage, caused by extreme heat or extreme cold, to the hold-down clips, to the hold-down means for the stationary ends of the panels, or to the panels themselves. The fixed ends of the panels in an inclined roof may be at the low end, at an intermediate part, or at the high end, with opposite or intermediate ends of the panel permitted to float.

OBJECTS OF THE INVENTION

One object of our invention is to provide an improved sliding hold-down clip for standing seam roofs in which failure of the roofing system, owing to thermal contraction, is avoided.

Another object of our invention is to provide a clip assembly for a standing seam roof which permits longitudinal expansion and contraction of the roof panels without damaging the clips, the panel-end fasteners, or the panels themselves.

Other and further objects of our invention will appear from the following description.

BRIEF DESCRIPTION OF THE DRAWINGS

In the accompanying drawings, which form part of the instant specification and which are to be read in conjunction therewith, and in which like reference numerals are used to indicate like parts in the various views.

DESCRIPTION OF THE PREFERRED EMBODIMENT

Figure 1:
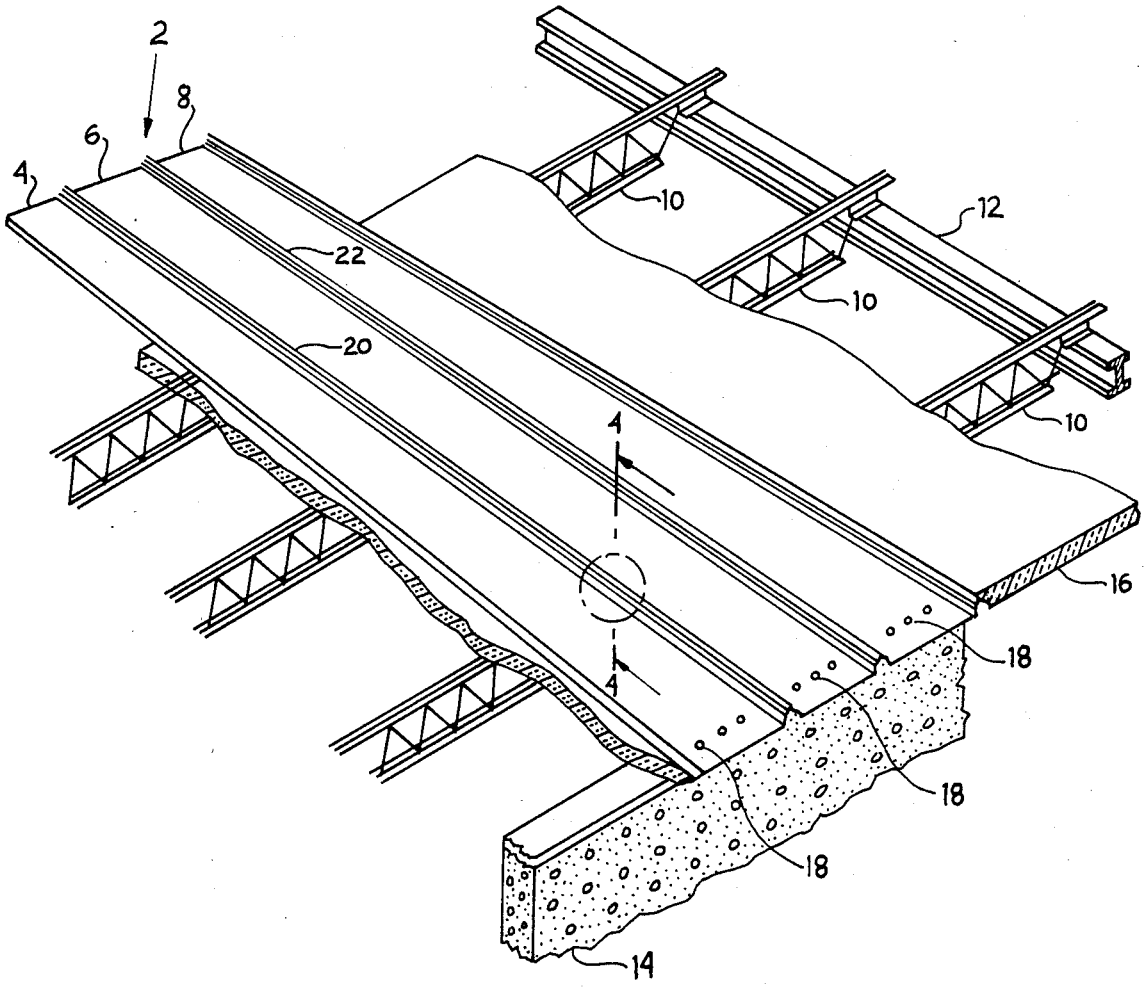
FIG. 1 is a fragmentary perspective view, showing a portion of a standing seam roof.

Referring now to the drawings, a standing seam roof, indicated generally by the reference numeral 2, comprises a plurality of panels such as 4, 6, and 8 carried by joists, or purlins, 10 which are supported in any appropriate manner. We have shown beams 12 which are supported by a building wall 14. The joists 10 are carried by the beam 12 and any desired supporting means at the opposite ends of the joists (not shown). Preferably, we employ insulation 16, over which we place the panels. In FIG. 1, the low ends of the panels are secured to the wall 14 by means of any appropriate fasteners 18. The other ends of the panels, which are formed from interconnecting sections, are permitted to float. It is understood that, if desired, the high ends or intermediate points may be fixed and the other parts of the interconnected panels may be permitted to float. Adjacent panels 4 and 6 form a standing seam 20. Adjacent panels 6 and 8 form a standing seam 22.

Figure 2:
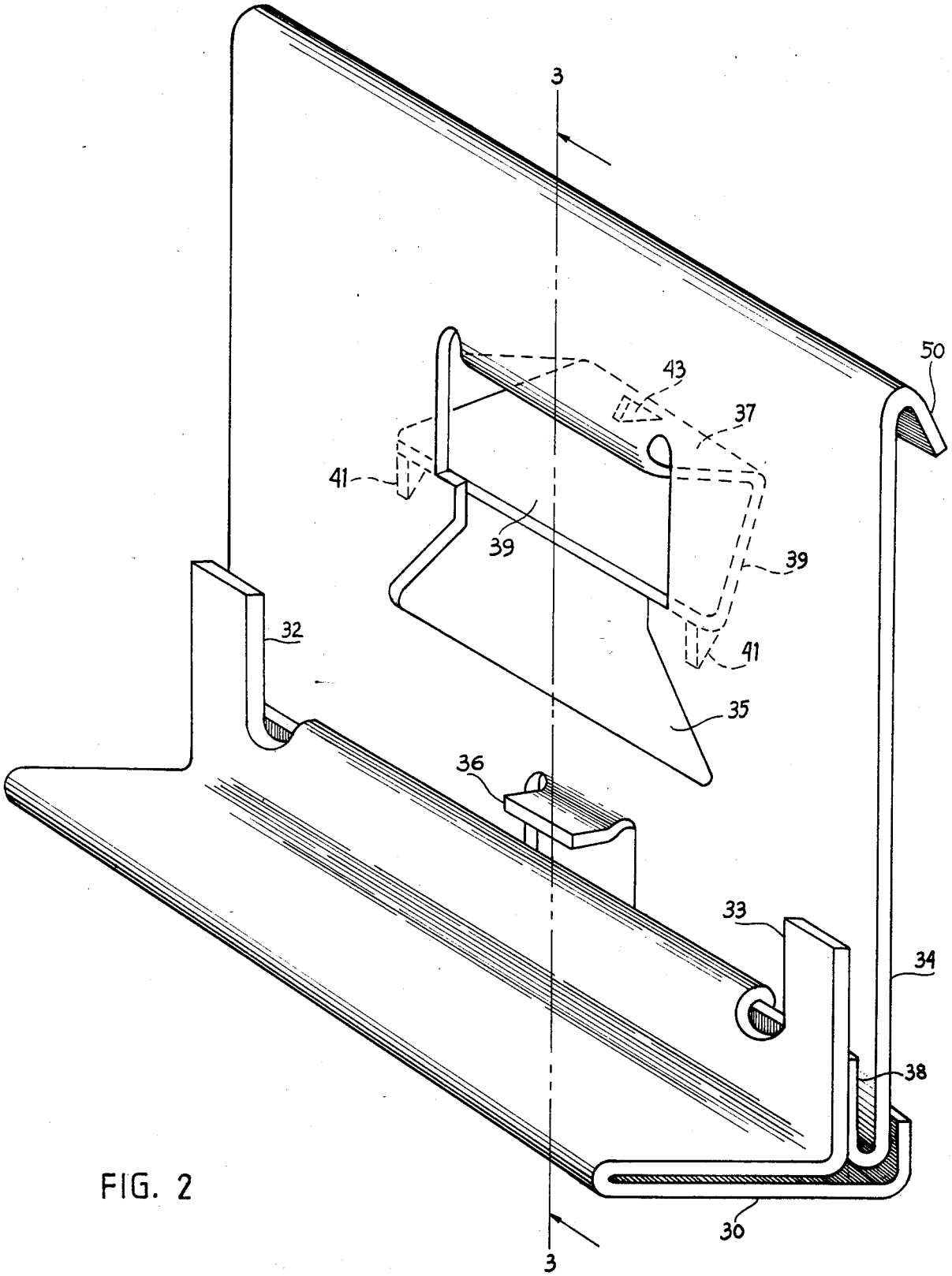
FIG. 2 is a perspective view, showing the sliding hold-down clip our invention.

The roof, formed by adjacent laterally and longitudinally connected panels, is secured to the purlins by means of hold-down clips. One of the hold-down clips is shown in FIG. 2, in which a base portion 30 of the clip is secured to a purlin in any appropriate manner (not shown). The base 30 is formed with a pair of stops 32 and 33. The base 30 of the hold-down clip slidably carries a hold-down portion 34. The sliding portion 34 is formed with a tab 36 adapted to contact the stops 32 and 33. It should be noted that the distance between the tab 36, carried by the sliding portion of the compound clip, and the stop 33, carried by the base, is less than the distance between the tab 36 and the stop 32. The sliding clip is mounted so that the greater distance is in the direction of the fixed end of the interconnected panels of the roof.

Figure 3:
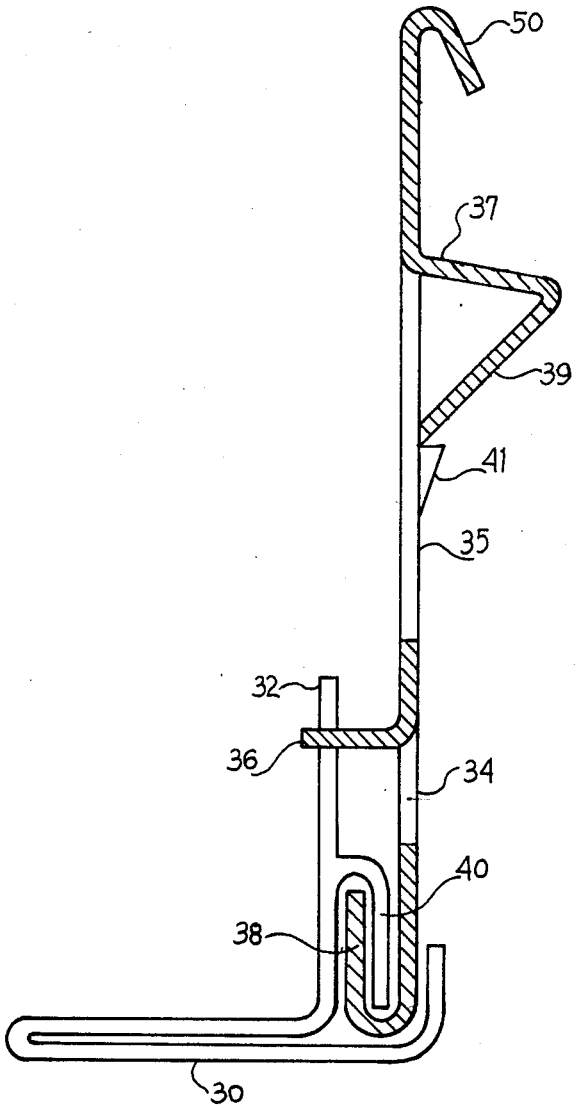
FIG. 3 is a sectional view, taken along the line 3—3 of FIG. 2.

Referring now to FIG. 3, the sliding portion 34 is formed with an upwardly directed end portion 38 adapted to coact and slide in a downwardly directed end portion 40 of the base 30. The central portion 35 of the sliding portion 34 is cut away to form a horizontally directed portion 37 and an inclined strut portion 39, as can readily be seen by reference to FIGS. 2 and 3. The strut strip 39 is supported by lugs 41, secured to the hold-down portion 34 in any appropriate manner, such as by welding. A tooth 43 is carried by the horizontally directed portion 37 of the panel.

Figure 4:
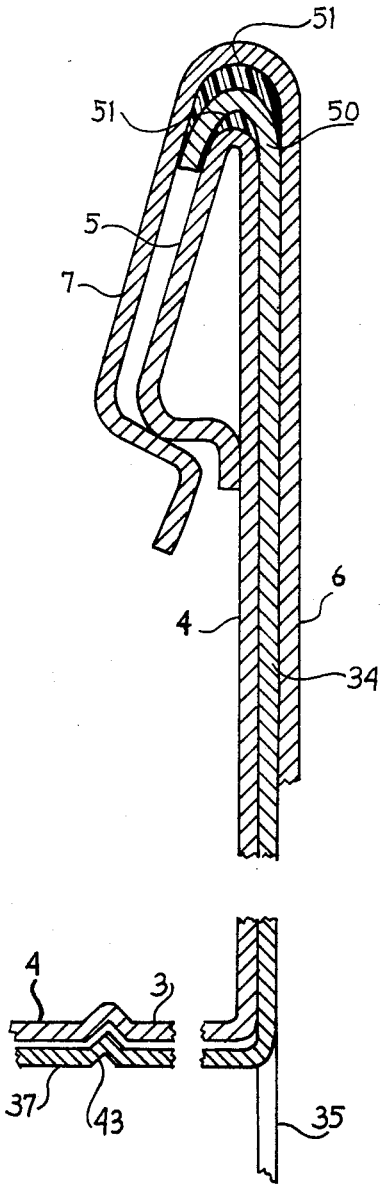
FIG. 4 is a fragmentary view, drawn on an enlarged scale, taken along the line 4—4 of FIG. 1.

As is known to the art and as can readily be seen by reference to FIG. 4, adjacent panels are formed with horizontal areas 3. These horizontal areas are supported on the horizontally directed portions 37 of the sliding clips. The tooth 43 is adapted to coact with horizontal area 3 of the panel 4 so as to prevent relative motion between the hold-down portion 34 of the sliding clip and the panel 4. The upper end of the sliding portion 34 of the hold-down clip is provided with a downwardly directed hook portion 50 which coacts with the upper part 5 of the panel 4. A sealant 51 is positioned between parts 5 and 50. The standing seam is completed by a downwardly directed portion 7 of the panel 6. The sealant 51 is also positioned between parts 7 and 50. It will be seen that the hold-down clip has its slidable element 34 positioned between two adjacent standing elements of the panels 4 and 6 and that relative motion between the sliding element 34 of the hold-down clip and the standing seam formed by the panels 4 and 6 is prevented.

The salient feature of the construction of our compound hold-down clip is the permitting of a greater amplitude of motion of the tab 36 and its stop 32 than exists between the tab 36 and the stop 33. It is important that the asymmetry of motion of the tab 36 before encountering a stop be such that more motion is permitted by the contraction of the panel toward the fixed end of the panel than is permitted toward the floating end of the panel. It is further understood that by "panel" we mean a plurality of panels interconnected at their adjacent ends, as is known to the art.

It will be seen that we have accomplished the objects of our invention. We have provided an improved sliding hold-down clip for standing seam roofs in which buckling, owing to thermal expansion, is permitted. We have provided a clip assembly which permits longitudinal expansion and contraction of roof panels without damaging the clips, the fixed end fasteners, or the panels themselves. The slight buckling of the panels, owing to expansion, is transient and does no permanent damage to the roofing system.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a standing seam roof for an infrastructure, said roof having a pair of adjacent roof panels formed with interleaved upwardly directed portions providing a standing seam, a compound clip having a lower base part adapted to be attached to said infrastructure and an upper hold-down part, said hold-down part positioned between said adjacent upwardly directed roof panel portions and coacting with said seam to prevent the seam from moving upwardly away from the hold-down part of said clip, a slidably interlocking joint between said hold-down part and said base part adapted to permit sliding motion between said upper and lower clip parts, means carried by said upper clip part to prevent relative longitudinal movement between said roof panel seam and said upper clip part, a projection carried by said upper clip part, a pair of stops positioned on opposite sides of said projection and adapted to coact with said projection to limit its sliding motion, and means for fixing one point of each of said roof panels against longitudinal motion while allowing the opposite points of the panels floating movement owing to thermal expansion and contraction, the distance between said projection and the stop nearer the floating points of the panel being less than the distance between said projection and the stop nearer the fixed point of the panel, the construction being such that it will accommodate excessive thermal expansion by allowing the roof panels to buckle, thus preventing permanent damage to the roofing system, while permitting contraction without placing the roof panels in tension, thus also preventing permanent damage to the roofing system.

2. A compound clip as in claim 1 in which said projection is formed integrally with said upper clip part.

3. A compound clip as in claim 1 in which said stops are formed integrally with said lower clip part.

4. A compound clip as in claim 1 in which said means carried by said upper clip part to prevent relative longitudinal motion between said roof panel seam and said upper clip part comprise a horizontal component and a tooth carried by said horizontal component.

5. A sliding clip as in claim 4 in which said horizontal component is formed integrally with said upper clip part.

* * * * *